United States Patent [19]

Neumark

[11] 4,163,297

[45] Aug. 7, 1979

[54] MATTRESS

[75] Inventor: Otto W. Neumark, Cheshire, England

[73] Assignee: Beaufort Air Sea Equipment Limited, Lancashire, England

[21] Appl. No.: 816,090

[22] Filed: Jul. 6, 1977

[30] Foreign Application Priority Data

Jul. 6, 1976 [GB] United Kingdom ..... 27959/76

[51] Int. Cl.[2] ..... A47C 27/00

[52] U.S. Cl. ..... 5/446; 5/455

[58] Field of Search ..... 5/345 R, 349, 350, 352, 5/91, 357, 326, 355, 365, 367, 361

[56] References Cited

U.S. PATENT DOCUMENTS

| | | | |
|---|---|---|---|
| 380,713 | 4/1888 | Clement | 5/357 |
| 2,415,150 | 2/1947 | Stein | 5/349 |
| 4,055,866 | 11/1977 | Evans | 5/91 |

FOREIGN PATENT DOCUMENTS

| | | | |
|---|---|---|---|
| 1397969 | 3/1964 | France | 5/326 |
| 6508757 | 10/1966 | Netherlands | 5/345 R |

*Primary Examiner*—Kenneth J. Dorner
*Attorney, Agent, or Firm*—Fleit & Jacobson

[57] ABSTRACT

Disclosed is a mattress comprising a plurality of smal pillow-like elements each of which consists of an envelope formed by a flexible membrane largely filled with a suitable fluid or grain-like material, and means for securing said elements side-by-side transversely of a bed.

The mattress when appropriately assembled is capable in use of greatly reducing the incidence of decubitus ulcers (bed sores) in patients and others who must spend a long period in bed.

The preferred embodiment disclosed consists of a sheet capable of being attached over a conventional mattress, and pillow-like elements measuring (unfilled) 30 cm by 90 cm, and filled to about 70% total capacity with spherical partly-expanded polystyrene beads of about 1.5 mm diameter. About twelve of these elements are secured to the sheet by touch-and-close material for use in a standard length bed.

9 Claims, 5 Drawing Figures

MATTRESS

This invention concerns beds.

Some hospital patients and others are confined to bed for long periods, and one of the problems inherent in such a situation is that the patient, if using a conventional bed, is susceptible to the development of decubitus ulcers (bed sores) due mainly to the fact that certain parts of the body repeatedly experience high pressures for extended times and this interferes with the circulation of the blood.

A number of specially designed and constructed bed bases, supports, or mattresses (hereinafter for convenience all called "mattresses") have been proposed in attempts both to prevent the incidence of bed sores and to promote the rapid healing of bed sores where they have occurred. For example, so-called water beds are known in which a patient lies on a mattress consisting of a large envelope filled with water. Mattresses filled with other kinds of material have also been proposed, such as sand and other particulate materials. True flotation beds are extremely effective both in the prevention and healing of bed sores. By a true flotation bed is meant a bed in which the mattress contains a displaceable material such as water which is capable of supporting the user, there being, between the water and the user, only a membrane, which membrane has sufficient freedom of movement to ensure that it does not become tensioned. In this way the localised high pressure regions which are the main cause of bed sores are avoided. However true flotation beds are quite expensive. Some at least of the other proposals which have been made are less expensive to put into effect, and although they are all less effective than true flotation beds they do help in reducing the incidence of bed sores. There is still a need for an inexpensive mattress which will be more effective in the prevention of bed sores, and it is the object of the present invention to provide such a mattress.

According to the present invention a mattress comprises a selected number of small pillow-like elements each of which consists of an envelope formed by a flexible membrane largely filled with a suitable fluid or grain-like material, and means for securing said elements side-by-side transversely of a bed. We have found that in use of such a mattress is not subject to "bottoming" of the membrane, (i.e. total displacement of the contained material at a location where pressure is applied by an occupant of the bed); that undesirably high membrane tensions (resulting in a correspondingly high reactionary pressure on the body of the occupant of the bed) are avoided; and that surface friction at the patient's body can be virtually eliminated, so that no shear forces arise in the patient's surface tissues. Another advantage is that such a mattress facilitates the manipulation of the patient as will later be described.

The means for securing the pillow-like elements in place will preferably consist of strips of touch-and-close material (e.g. that sold under the Registered Trade Mark VELCRO), lying longitudinally of the upper surface of a bed base or a sheet which lies over a bed base, complementary tabs of touch-and-close material being appropriately positioned on the pillow-like elements.

Conveniently the pillow-like elements will consist of an envelope of fairly thin textile material with a filling of small beads of a partly expanded polystyrene. It has been found that a suitable envelope size (unfilled) is 90 cm×30 cm. We prefer that each envelope be filled to between 60% and 75% of its full capacity with beads of between 1 mm and 2 mm in size and preferably spherical.

The invention will now be described further by way of example only with reference to the accompanying drawings in which.

Figure 1:
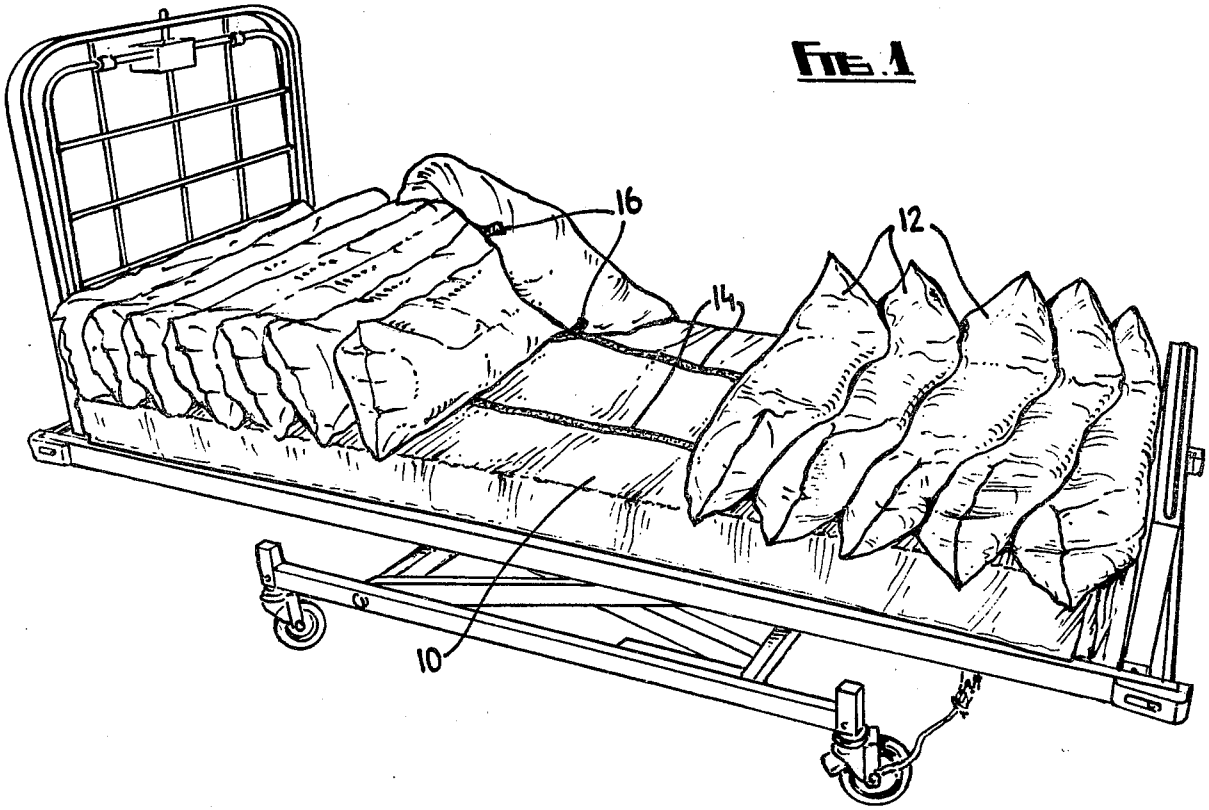
FIG. 1 illustrates a mattress constructed according to the present invention, but only partly assembled.
Figure 2:
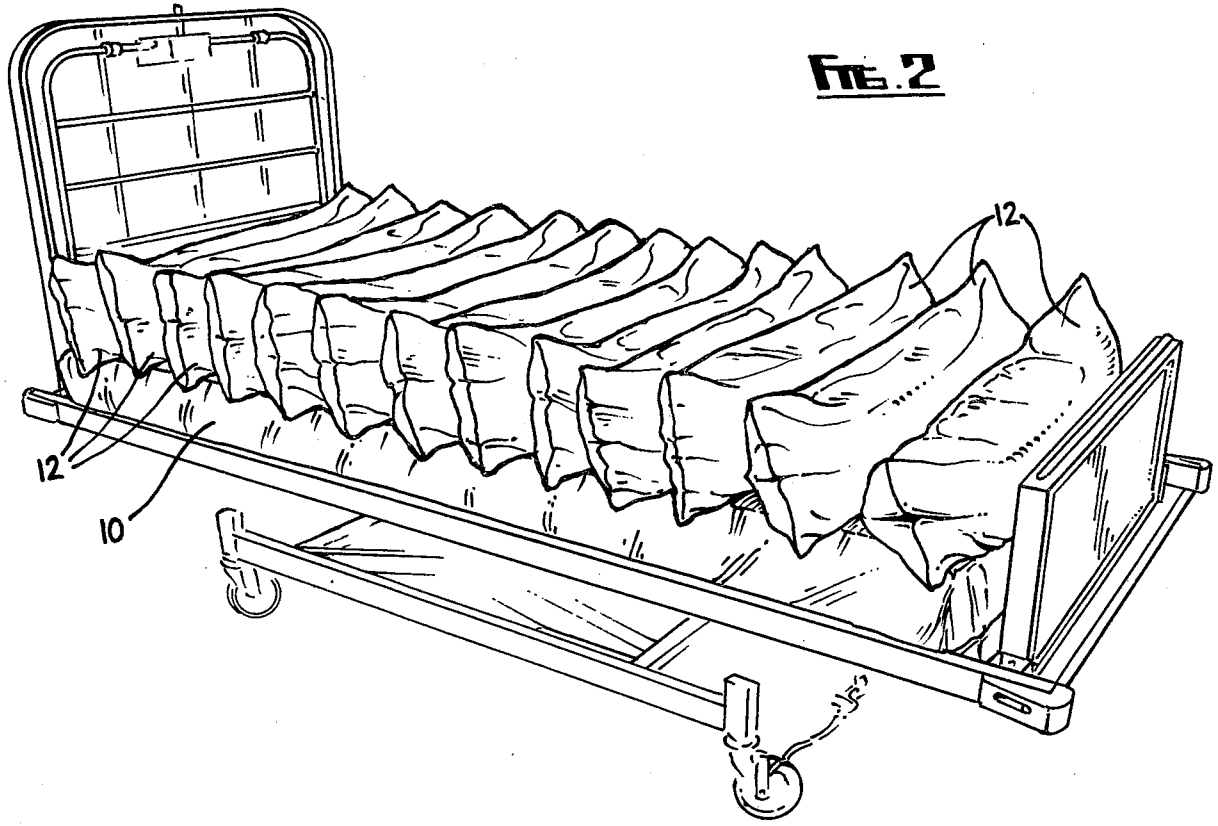
FIG. 2 shows a mattress fully assembled.
Figure 3:
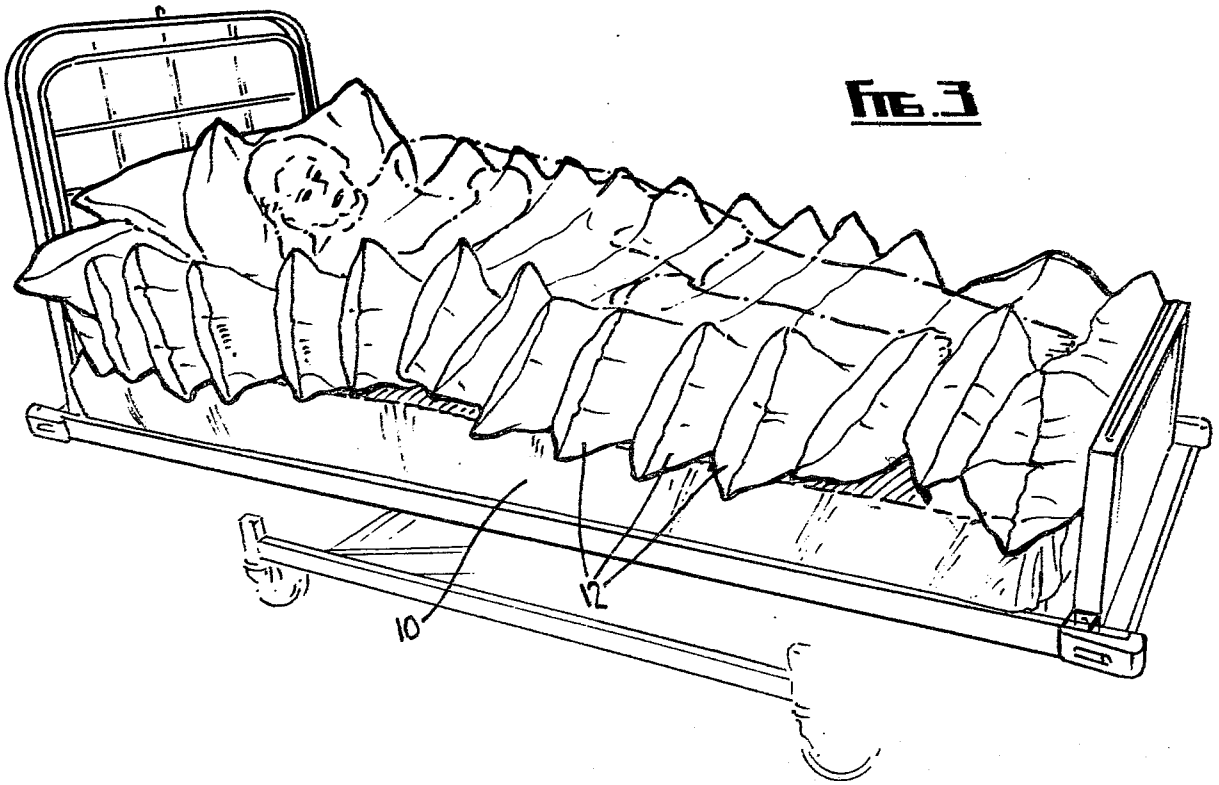
FIG. 3 shows a fully assembled mattress in use by a patient.

The mattress consists of a base sheet 10 and a number of pillow-like elements 12 (hereinafter called "pillows"). The sheet is of conventional size, namely 245 cm×150 cm, and is made from polyvinyl chloride. It may conveniently be provided with cross straps (not shown) for strapping round the exisiting mattress on a standard bed. Longitudinally down the central region of the sheet are secured two strips 14 of touch-and-close material spaced apart by about 35 cm. The pillows are made from nylon and each, in the unfilled condition, measures 30 cm×90 cm. Each pillow is filled to 70% capacity with pre-expanded spherical polystyrene beads of approximately 1.5 mm diameter. Each pillow has two tabs 16 of touch-and-close material complementary to the touch-and-close material on the sheet and so positioned that the tabs on a pillow may both be pressed into contact with the strips of touch-and-close material on the sheet so as to secure the pillow transversely in position on the sheet as illustrated in FIGS. 1 to 3. We have found that with about twelve such pillows in a bed of standard length, a very satisfactory result is obtained. If substantially fewer pillows are used they are too widely spaced and do not provide mutual support, and consequently a patient lying on the bed would find that parts of his body would "bottom", that is they would come into contact with the standard mattress beneath, which is undesirable. If substantially more than twelve pillows are used, then they become too closely spaced and provide too much mutual side support, in which case a patient would lie high on top of all the pillows, not sinking into them and too high contact pressures would arise. Furthermore, about twelve pillows not only enables the assembly to provide support without localised high pressures on the body of the user, but at the same time gives enough freedom of movement of the pillows to enable them to go with the patient's movements longitudinally of the bed and thereby very substantially reduce shear forces in the patient's body tissues. Thus, in the particular embodiment example being described, twelve pillows or thereabouts would be the "selected number". The selected number may be readily ascertained by experimentation in other cases.

Figure 4:
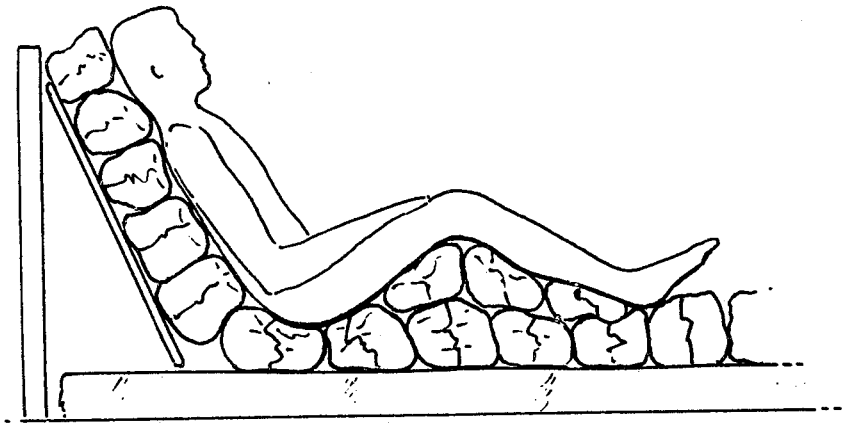
FIGS. 4 and 5 are diagrams illustrating how the mattress may be adapted to different postures of a patient.
Figure 5:
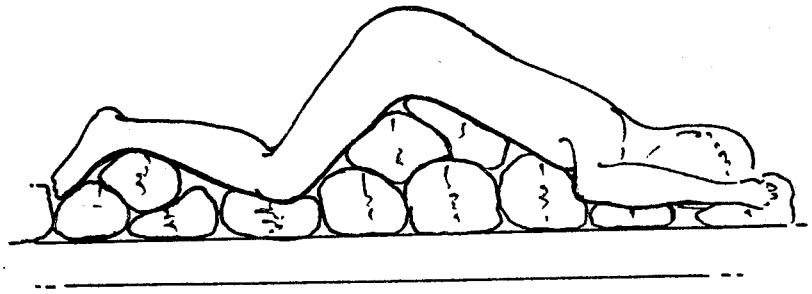

Of course more than just twelve pillows will be provided, since by using additional pillows a patient may very conveniently be comfortably supported in various postures. FIG. 4 illustrates diagrammatically how a patient may be supported in a sitting-up posture in a bed having a back support. Additional pillows may be loosely packed under the patient's knees to give additional comfort. In FIG. 5 a patient is shown in the prone position which is necessary for certain medical purposes. Extra pillows are loosely packed under the patient's torso and feet.

Some pillows may have polyvinyl chloride envelopes, and these may be used in appropriate areas when the bed is occupied by an incontinent patient. If desired an ordinary pillow may be used for the head, though the patient may eventually prefer to use one of the pillows of the invention. The mattress of the invention should preferably be used on beds with effective head and foot boards, but if there are no such foot boards then ordinary pillows may be employed at the head and foot of the bed to prevent the other pillows from splaying out longitudinally of the bed.

In use, when the mattress has been assembled as previously described, the patient lies directly on the pillows, either on his back or on his side. If on his side then the knees and legs should be spread out. The patient should then wriggle, or if this is not possible, the attendant or nurse should tap all the ends of the pillows towards the patient on both sides in an exaggerated manner. In this way the patient is caused to sink down in each pillow, the beads inside the pillows rising towards the ends thereof to provide side support for the patient. It may be necessary to assist the heels to sink down into the pillows. If the patient is lying on his side then the upper arm and shoulder should be allowed to sink down between two adjacent pillows.

The pillows are readily laundered either by hand or in a washing machine, though certain precautions should be taken, as, for example, the use of very hot water should be avoided since the beads would be caused thereby to expand substantially.

The invention of course is not limited to the particular details of construction of the embodiment just described. For example, the manner of attaching the pillows to the sheet may take other forms. Thus, buttons, press-studs or ties may be used. Also the contents of the pillows may be other than of polystyrene, and whilst it is preferred to use solid granular material, alternatives being beads, seeds, pigeon peas or sand, the use of liquid, gel or gas is not precluded. In order to avoid the need for frequent laundering of the pillow proper an additional changeable outer cloth case may be provided for each pillow. In another embodiment, a complete mattress pack may be provided, consisting of a carrying and storage bag, the appropriate number of pillows, and a sheet to which the elements can be temporarily attached when the mattress is in use, and which may have shaped ends and sides with ties for containing the elements.

I claim:

1. A bed mattress comprising a longitudinally-extending support; a selected number of small pillow-like elements positioned on said support; and connection means for quick releasably connecting said elements to said support, each element comprising an envelope formed by a flexible membrane defining an internal volume and granular material filling the internal volume to not more than 75% of its maximum capacity, said elements having first spaced-apart components of said connection means for quick releasably securing said elements at longitudinal edges thereof to second components of said connection means associated with said support, said elements being positioned in spaced side-by-side relationship to provide a predetermined limited amount of support for each other and to provide full support for at least part of a body of a user, said elements being adapted to be collectively deformed by the body until their respective internal volumes are fully occupied by said granular material, said second components of said connection means being formed as spaced-apart members extending parallel to the longitudinal axis of the support.

2. A bed mattress as claimed in claim 1 further comprising a sheet, said second components of said connection means being positioned on said sheet to secure said elements in said spaced side-by-side relationship.

3. A bed mattress as claimed in claim 2 in which said attachment members are comprised of touch-and-close material of the type sold under the trademark VELCRO.

4. A bed mattress as claimed in claim 1 in which said elements are partially filled with beads of partly-expanded polystyrene.

5. A bed mattress as claimed in claim 4 in which said beads are spherical and of a diameter of from 1 mm to 2 mm.

6. A bed mattress as claimed in claim 1 in which each element is filled to between 60% and 75% of its maximum capacity.

7. A bed mattress positionable on a base comprising: a longitudinally-extending sheet member having a lower surface positionable in contact with the base and an upper surface positionable facing away from the base;

a plurality of longitudinally-extending pillow-like elements positionable on the sheet member with the longitudinal axes of the pillow-like elements transverse to the longitudinal axis of the sheet member, each of said pillow-like elements having an internal volume defined by a flexible membrane forming an envelope and granular material filling the internal volume to not more than 75% of its maximum capacity; and complementary fastening means of the type sold under the trademark VELCRO for quick releasably fastening said pillow-like elements in spaced side-by-side relationship, the spacing being such that a limited degree of longitudinal and transverse movement of granular material within individual pillow-like elements occurs under the weight of a user, said complementary fastening means having a plurality of longitudinally-extending first components having looped members positioned on the upper surface of a sheet member and a plurality of second components having hook members engageable with said looped members positioned on and extending transversely on said pillow-like elements whereby said second components mate with said first components to position said pillow-like elements on the sheet member.

8. A bed mattress as claimed in claim 7 in which said elements are partially filled with beads of partly-expanded polystyrene.

9. A bed mattress as claimed in claim 8 in which said beads are spherical and of a diameter of from 1 mm to 2 mm.

* * * * *